US005866271A

United States Patent [19]

Stueber et al.

[11] Patent Number: 5,866,271

[45] Date of Patent: Feb. 2, 1999

[54] METHOD FOR BONDING THERMAL BARRIER COATINGS TO SUPERALLOY SUBSTRATES

[76] Inventors: Richard J. Stueber; Frank Boorboor; Natarajan S. Palanisamy, all of 2015 W. Alameda Dr., Tempe, Ariz. 85282

[21] Appl. No.: 954,801

[22] Filed: Oct. 21, 1997

Related U.S. Application Data

[63] Continuation of Ser. No. 502,232, Jul. 13, 1995, abandoned.

[51] Int. Cl.[6] ..... B32B 7/04; B32B 15/04; C23C 4/02; C23C 8/02

[52] U.S. Cl. ..... 428/545; 428/609; 428/668; 428/679; 428/332; 428/633; 427/455; 427/250; 148/527; 148/240

[58] Field of Search ..... 428/544, 545, 428/660, 609, 938, 612, 632, 633, 680, 679, 668, 601, 610, 332, 697; 427/454, 250, 455; 148/527, 537, 240, 30

[56] References Cited

U.S. PATENT DOCUMENTS

| | | | |
|---|---|---|---|
| 4,321,311 | 3/1982 | Strangman | 428/623 |
| 4,399,199 | 8/1983 | McGill | 428/633 |
| 4,447,503 | 5/1984 | Dardi et al. | 428/632 |
| 4,576,874 | 3/1986 | Spengler | 428/623 |
| 4,615,864 | 10/1986 | Dardi et al. | 420/437 |
| 5,124,006 | 6/1992 | Fayeulle et al. | 205/195 |
| 5,236,745 | 8/1993 | Gupta | 427/454 |
| 5,238,752 | 8/1993 | Duderstadt et al. | 428/623 |
| 5,262,245 | 11/1993 | Ulion | 428/469 |
| 5,302,465 | 4/1994 | Miller et al. | 428/552 |
| 5,350,599 | 9/1994 | Rigney et al. | 427/255.7 |
| 5,384,200 | 1/1995 | Giles et al. | 428/552 |
| 5,403,669 | 4/1995 | Gupta et al. | 428/550 |
| 5,419,971 | 5/1995 | Skelly et al. | 428/612 |
| 5,427,866 | 6/1995 | Nagaraj et al. | 428/610 |
| 5,498,484 | 3/1996 | Duderstadt | 428/633 |
| 5,512,382 | 4/1996 | Stangman | 428/632 |
| 5,562,998 | 10/1996 | Stangman | 428/612 |
| 5,658,614 | 8/1997 | Basta et al. | 427/253 |
| 5,716,720 | 2/1998 | Murphy | 428/623 |

*Primary Examiner*—John J. Zimmerman
*Assistant Examiner*—Michael LaVilla
*Attorney, Agent, or Firm*—John D. Titus; Bryan Cave, LLP

[57] ABSTRACT

A method is provided for bonding a ceramic thermal barrier coating to a nickel or cobalt based superalloy substrate for use in high temperature applications such as gas turbine engines. The method comprises roughening the superalloy substrate itself to produce a surface roughness, preferably from 100 to 350 microinches Roughness Average (RA). The roughened surface of the substrate is treated with a diffusion coating, preferably aluminide or platinum-aluminide to provide oxidation and hot corrosion resistance, while substantially preserving the micro-topography of the roughened surface. A ceramic thermal barrier coating is applied directly to the diffusion treated surface, preferably using an air plasma spray. The surface roughness, which is left substantially undisturbed by the diffusion coating treatment, is altered by the air plasma sprayed ceramic to form a series of interlocking microstructures that firmly attach the ceramic thermal barrier coating to the diffusion treated superalloy substrate. The method creates an inexorable bond between the ceramic thermal barrier coating and the substrate without the need for costly Low Pressure Plasma Sprayed MCrAlY bond coats or costly Electron Beam Physical Vapor Deposited ceramic.

21 Claims, 2 Drawing Sheets

METHOD FOR BONDING THERMAL BARRIER COATINGS TO SUPERALLOY SUBSTRATES

This application is a continuation of application Ser. No. 08/502,232, filed Jul. 13, 1995, now abandoned.

BACKGROUND OF THE INVENTION

This invention relates to application of a thermal barrier coating to the metallic components used in the construction of gas turbine engines, specifically to application of a ceramic-based thermal barrier coating to an oxidation/sulfidation resistant diffusion coating over a nickel or cobalt-based superalloy substrate.

It is well known that the thermodynamic efficiency of gas turbine engines increases with the temperature at which the turbine is operated and, therefore, that it is desirable to operate a gas turbine engine at the highest practical temperature. It is also well known that most gas turbine engines must operate in the ambient environment where the high temperature engine components are exposed to the oxidizing and corrosive effects of the ingested constituents of the ambient air and fuel. Accordingly, materials used to fabricate gas turbine components ideally should have both good high temperature mechanical properties and should exhibit a high degree of resistance to surface degradation such as by oxidation or sulfidation (hot corrosion) at high temperature. Nickel and cobalt-based superalloys possess exceptional high temperature mechanical properties, however, they are prone to degradation from the oxidizing and corrosive effects of the environment. As is well-known in the art, nickel and cobalt-based superalloys are superalloys in which nickel and cobalt, respectively, are the single greatest constituent by weight.

Oxidation and sulfidation (hot corrosion) resistant coatings have been applied to turbine hot-section components for many years with positive results. A popular oxidation/sulfidation resistant coating is a metallic diffusion coating, typically an aluminide, however, metallic diffusion coatings may also contain a variety of other protective elements including chromium, nickel, cobalt, silicon, and platinum-group metals (i.e. platinum, palladium, and rhodium) plus lesser amounts of strong oxide forming elements such as tantalum, hafnium and yttrium. The term "metallic diffusion coating" is well-known in the art and is described in the patent literature including in U.S. Pat. No. 3,716,398 to Stueber et al., and U.S. Pat. No. 3,617,360 to Levine. "Metallic diffusion coating" defines a class of coatings that are applied by exposing the article to be coated to a halide vapor carrying the coating material (typically an aluminide) in an inert or reducing atmosphere. As used herein, the term "metallic diffusion coating" specifically excludes MCrAlY coatings, which are members of the class of coatings known in the art alternatively as "overlay coatings" or "bond coatings."

As demands for ever increasing fuel efficiency mount, however, engineers are designing turbine engines to operate at temperatures that approach or even exceed the melting point of even the highest temperature superalloys. Accordingly, in addition to the oxidation/sulfidation resistant coating (hereinafter "diffusion coating"), many engine designs now require a second thermal barrier coating ("TBC") to reduce the surface temperature of the superalloy substrate. Typical TBCs include ceramics such as yttria-stabilized zirconia.

Methods for bonding the ceramic TBC to the superalloy substrate have been the subject of numerous patents.

Because the ceramic TBC is relatively stable and non-reactive, chemical adherence of the TBC to most materials is poor. Additionally, the difference in thermal coefficients of expansion between the substrate and the TBC generate stress that tends to cause spallation of the TBC from the surface. Accordingly, most investigation and patents relating to bonding TBCs to substrates has focused on improving the weak chemical adherence of the TBC through the use of bond coatings and the like.

U.S. Pat. No. 4,32)1311 to Strangman discloses a bond coating comprising a layer of MCrAlY (where M is an element chosen from the group consisting of Fe, Ni, or Co or alloys thereof, Cr is chromium, Al is aluminum and Y is yttrium) deposited onto the superalloy substrate. The bond coating is deposited preferably by Electron Beam Physical Vapor Deposition (EBPVD). After the MCrAlY bond coating is aluminized, a ceramic TBC is applied also preferably by EBPVD to produce a columnar grain structure. The ceramic TBC is stated to have some degree of solid solubility in the aluminized MCrAlY, which is the basis for the chemical adherence of the TBC to the MCrAlY.

U.S. Pat. No. 4,399,199 to McGill, et al. discloses a substantially pure platinum bond coat applied between the substrate and the ceramic TBC.

U.S. Pat. No. 5,238,752 to Duderstadt, et al. discloses a nickel aluminide bond coating onto which the ceramic TBC is deposited, preferably by EBPVD.

U.S. Pat. No. 5,262,245 to Ulion, et al. discloses a new superalloy having the capability of forming a thermally grown alumina scale on its outer surface onto which a ceramic TBC is deposited directly, preferably by EBPVD.

Receiving substantially less attention has been the development of methods to improve the mechanical bonding of the TBC to the substrate. U.S. Pat. No. 5,236,745 to Gupta, et al. discloses an air plasma sprayed bond coat that is applied to the substrate to produce a surface roughness of preferably 200–600 microinches RA. The patent teaches that the bond coat is thereafter aluminized to improve the chemical bonding of the TBC to the bond coat while maintaining the surface roughness.

None of the prior art, however, discloses or suggests mechanical treatment of the substrate itself to eliminate the bond coating, while maintaining a suitable bond between the ceramic TBC and the diffusion coated substrate.

Accordingly, it is a principal object of the present invention to provide a ceramic TBC that is mechanically bonded to a diffusion coated superalloy substrate without the need for a bond coating.

SUMMARY OF THE INVENTION

The present invention includes a description of an improved method for applying a ceramic thermal barrier coating to a superalloy substrate, which in a preferred embodiment includes preparation of the surface of the substrate by roughening, diffusion coating the substrate to provide oxidation and hot corrosion resistance, followed by direct bonding of the thermal barrier coating to the diffusion coated substrate, without the need for a bond coating of any kind. Because the surface preparation is carried out on the substrate prior to the diffusion coating process, the diffusion coating is not degraded by the surface preparation. Instead, the diffusion coating uniformly diffuses into and faithfully follows the microscopic contours of the surface.

According to a preferred embodiment of the present invention, application of the thermal barrier coating, as well as the diffusion treatment may be carried out at substantially atmospheric pressure, thereby eliminating the need for costly equipment and time consuming operations associated with the vacuum conditions necessary for conventional application of most bond coatings and their associated thermal barrier coatings.

Preferably the TBC is applied by an air plasma spray process which, due to the high temperature (typically about 3000° to 4500° F.) and the high velocity (typically 400 to 500 feet per second) of the ceramic material as it is applied, modifies the roughened surface of the substrate. As the ceramic in this plastic condition (hereinafter "plastic ceramic") is applied to the substrate, the peaks on the roughened surface apparently soften and bend, then harden along with the ceramic, so that the diffusion coated substrate and ceramic form interlocking surface microstructures. Accordingly, the method of the present invention produces an unexpectedly tenacious bond between the TBC and the substrate.

BRIEF DESCRIPTION OF THE DRAWINGS

The above and other objects, aspects, features and attendant advantages of the present invention will become apparent from a consideration of the ensuing detailed description of presently preferred embodiments and methods thereof, taken in conjunction with the accompanying drawings, in which.

DESCRIPTION OF PREFERRED EMBODIMENTS AND METHODS

According to the present invention, the surface of the substrate, which may be any material suitable for use in a turbine engine but is preferably a nickel, cobalt or nickel-cobalt based superalloy, is treated to produce a surface roughness of from about 100 to about 350 microinches Roughness Average (RA) (preferably 200 to 300 microinches). "Roughness Average" ("RA" or "$R_a$") is a well known term in the art used for describing surface finishes and is defined, among other places, in the International Standard ISO 468 and ISO 4287. It has been found that a surface smoother than about 100 microinches RA produces an inadequate mechanical bond between the substrate and the TBC. Conversely, a surface roughness of greater than about 350 microinches produces a surface that promotes potentially catastrophic discontinuities in the diffusion coating, and may also promote structural failures in extremely thin-section components.

Although grit blasting is the preferred method, other techniques such as blasting to a surface roughness depth of 0.002 inch with a high pressure water jet, or laser cutting a pattern of grooves about 0.002 inch deep spaced apart by about 0.001 to 0.002 inch also produce satisfactory results.

After the surface of the substrate has been prepared as described above, a conventional oxidation/sulfidation resistant diffusion coating is applied using any of several procedures well known in the art, such as pack cementation, chemical vapor deposition, or slurry. Although the diffusion coating is primarily aluminum, combinations of chromium, nickel and silicon, may also be applied. In a preferred embodiment, one or more members of the platinum group are plated onto and diffused into the superalloy prior to the pack cementation process for improved resistance to hot corrosion. Because the diffusion coating substantially diffuses into the substrate, rather than merely bonding to the surface, the diffusion coating treatment does not significantly alter the surface roughness of the substrate. Instead the micro-topography of the substrate is faithfully reproduced by the surface of the diffusion coating. This method of producing a roughened diffusion coated surface is much preferable to roughening the surface after the diffusion coating because, of necessity, any roughening treatment will remove some material. Removal of even a small amount of most diffusion coatings would severely degrade the effectiveness of the coating. This is especially true of platinum aluminide diffusion coatings, where the most highly protective platinum rich portion of the coating is typically only about 0.001 inch thick.

Figure 1:
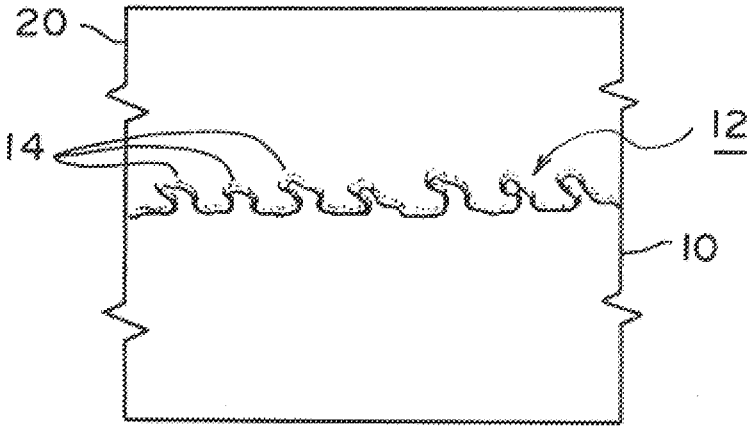
FIG. 1 is a drawing of the bonding interface created between a ceramic thermal barrier coating and a metallic diffusion coated superalloy substrate according to an embodiment of the present invention.

The ceramic TBC is thereafter applied, preferably by conventional air plasma thermal spray coating process. As the plastic ceramic is applied to the substrate, the sharp peaks of the substrate surface apparently soften and bend, then harden along with the ceramic so that the substrate and ceramic form interlocking surface microstructures. As shown schematically in FIG. 1, the substrate 10 forms a series of hook-like microstructures 14 in the surface 12. Simultaneously, the ceramic TBC 20 flows between the microstructures 14 and hardens to form an inseparable mechanical bond between the two materials.

Experiments were conducted using nozzle guide vanes from an Allison 501K engine used in extremely severe conditions in turbine-powered hydrofoil boats. The guide vanes were removed from service after only 1000 hours of operation for refurbishment. The guide vanes exhibited thermal fatigue cracking in several places along the leading edges as well as extensive sulfidation erosion. The vanes were repaired according to standard practices and were then treated according to the present invention. The vanes were returned to the same service conditions and have now seen over 2000 hours of operation without noticeable degradation.

According to a preferred embodiment of the TBC bonding method of the present invention the superalloy component is vacuum cleaned according to conventional methods by heating the components to about 1800° to 2000° F. (preferably 1925°±25° F.) in a vacuum furnace for about 1 to 4 hours (preferably 2 hours) then quenching with argon to below 200° F. The gas path of the component is then grit blasted using 180 to 240 mesh (preferably 220 mesh) aluminum oxide at 20 to 80 psi (preferably 50 psi) for 25 to 30 seconds at a stand off distance of 2 to 10 inches (preferably 6 inches) to obtain a surface roughness of about 60 to 140 microinches RA (preferably 80 to 100 microinches).

The area to be coated with the TBC is then grit blasted using 16 to 32 mesh (preferably 24 mesh) aluminum oxide at 40 to 100 psi (preferably 60 to 80 psi) for 15 to 20 seconds using conventional grit blasting equipment, for example a Zero blast & peen apparatus Model #50-2-300R/BG1PH manufactured by Zero Manufacturing of Washington, Mon. A nozzle extension attachment with a 0.375 inch orifice and a standoff distance of 1 to 4 inches (preferably 1 to 1½ inches) should be used to obtain the required surface roughness of 100 to 350 microinches (preferably 200 to 300 microinches).

The components are then ultrasonically cleaned in a conventional manner by immersion in trichloroelylene at 160° to 180° F. for about 15 to 20 minutes. Where the components are to be plated prior to application of the diffusion coating, such as where a platinum aluminide coating is desired, the component is plated using conventional electroplating or electroless plating techniques. Thereafter the component is subjected to conventional post-plate diffusion heat treatment in a vacuum furnace at 900°±25° F. for 30 minutes followed by treatment at 1500°±25° for 30 minutes, followed by treatment at about 1800° to 2000° F. for 1 to 4 hours followed by an argon quench to below 200° F.

Thereafter, the components are diffusion coated according to conventional pack cementation methods such as by packing the component in pre-reacted chromium aluminum diffusion pack powder, for example, LB202 diffusion coating powder. The chromium aluminum diffusion pack is freshly prepared then pre-reacted by heating to a temperature of about 1800° to 2200° F. for 1 to 12 hours, then screened. The components are then packed in the screened diffusion coating powder and reacted at 1550° to 2000° F. (preferably 1925°±25° F.) for 4 to 20 hours (preferably 7 hours) in a hydrogen atmosphere.

The pack composition may range in weight from 5% to 40% chromium (preferably 10% to 30%), with the aluminum ranging from about 0.125% to 20% (preferably 0.125% to about 5% aluminum), a small amount of halogen energizer (about 0.125% to 2%), with the balance a diluent such as alumina, zirconia, or other refractory oxides.

After the components are ultrasonically cleaned in trichloroethylene the Thermal Barrier Coating is applied preferably using an air plasma thermal spray coating process to a thickness of 0.003 to 0.010 inch (preferably 0.006 to 0.008 inch) using a conventional APS robot such as a ABB Robotics, ASEA Model IRB6. The TBC material is preferably a 4% to 20% (most preferably 6% to 8%) yttria stabilized zirconia powder of 10 to 75 micron particle size, such as Metco 204 NS powder. The TBC is applied using a powder feed rate of 8 to 16 pounds per hour (preferably 12 pounds per hour using 10.2 rpm setting on the powder feeder). Robot program 899 main and 8991 Sub with a gun distance of 2 to 8 , inches (preferably 4 to 5 inches) and a linear speed of 690 feet per minute have achieved satisfactory results. Preferably the components are preheated to about 100° to 500° F. (most preferably 250° to 350° F.) and the coating is applied using 6 to 18 spray cycles (most preferably 11 to 13 cycles) to achieve the desired coating thickness.

After the TBC is applied, the components are surface finished, such as by conventional vibratory polishing, to obtain a surface roughness of about 40 to 100 microinches on the gas path surface of the component.

Figure 2:
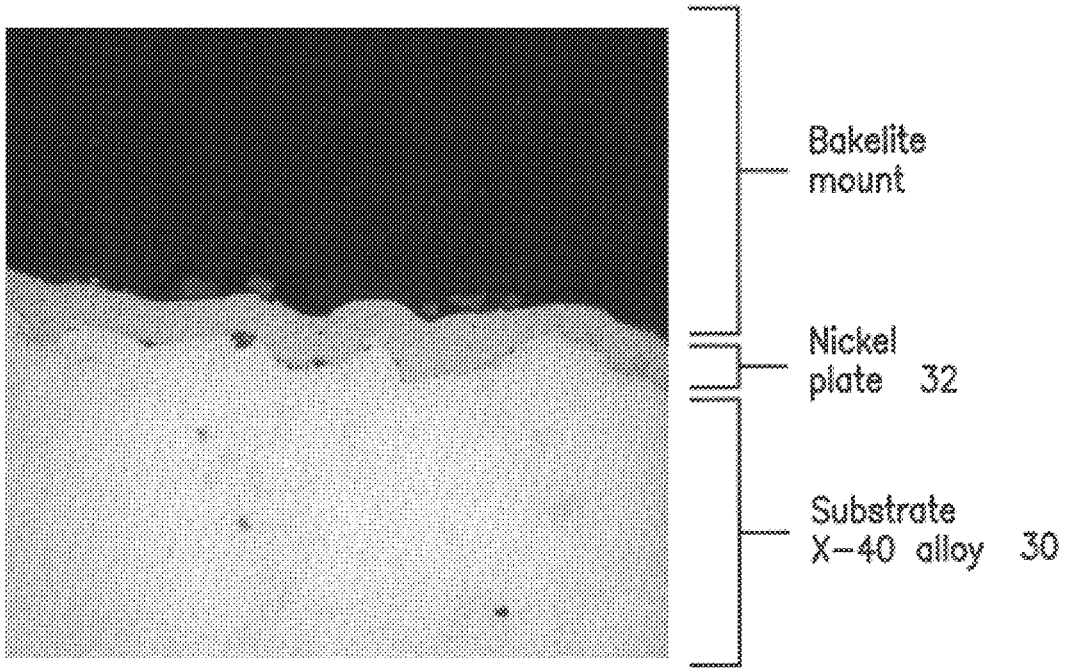
FIG. 2 is a photomicrograph showing a surface of a superalloy substrate roughened according to an embodiment of the present invention.
Figure 3:
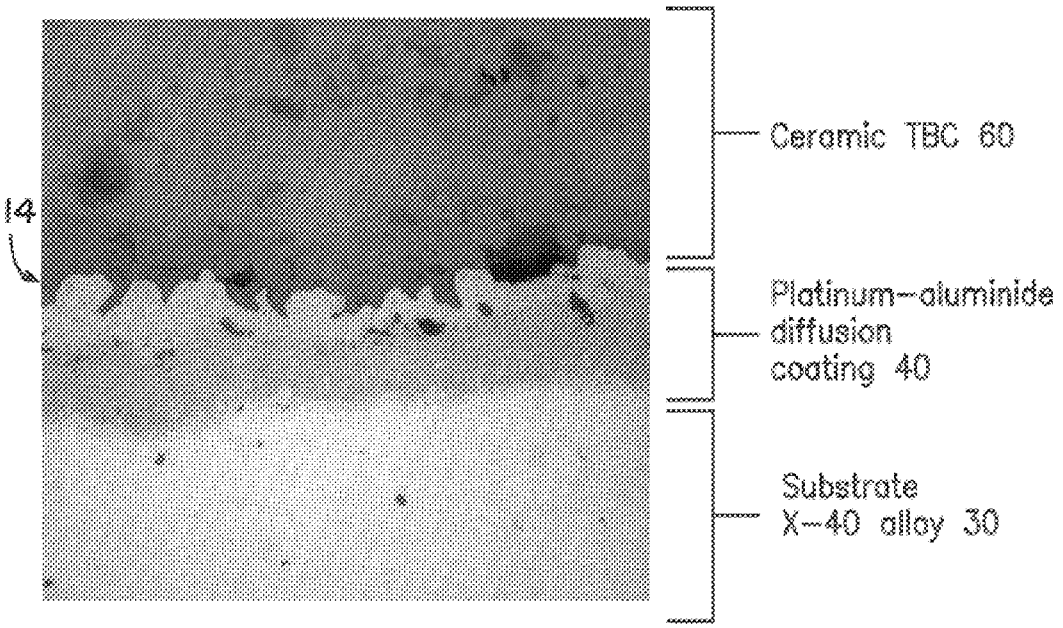
FIG. 3 is a photomicrograph showing a thermal barrier coating bonded to the surface of a platinum aluminide diffusion coated superalloy according to an embodiment of the present invention.
Figure 4:
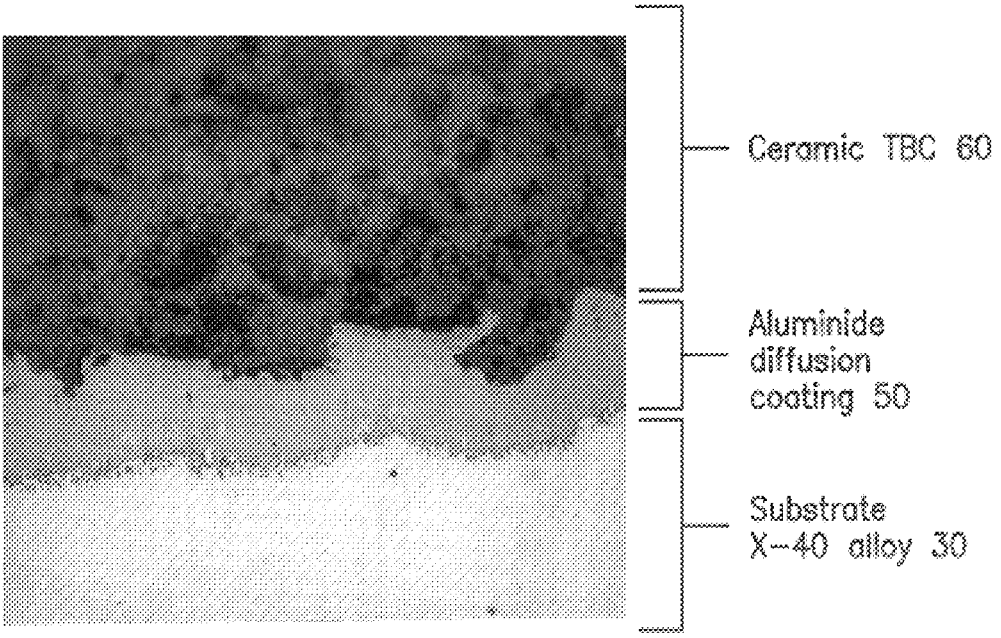
FIG. 4 is a photomicrograph showing a thermal barrier coating bonded to the surface of an aluminide diffusion coated superalloy according to an embodiment of the present invention.

The surprising effect of the foregoing treatment on the micro-topography of the superalloy substrate surface is demonstrated with reference to FIGS. 2–4. FIG. 2 is a photomicrograph (approximately 400× magnification) showing a superalloy substrate (Alloy X-40) 30 after grit blasting. (A nickel plating 32 was applied to the roughened surface for edge retention during specimen preparation for metallographic examination.) As can be seen from the photomicrograph, the surface roughening produces a series of peaks and valleys, but no hook-like microstructures to grasp a subsequently applied TBC.

FIG. 3 is a photomicrograph (approximately 400× magnification) showing a superalloy substrate (Alloy X-40) 30 after a ceramic TBC 60 has been applied according to the present invention. In this case, a platinum aluminide diffusion coating 40 was diffused into the substrate and the TBC 60 applied thereafter. As can be seen clearly from FIG. 3, the surface of the substrate has been modified from the simple peaks-and-valleys micro-topography of the grit blasted surface into a series of interlocking surface microstructures 14 that firmly bond the TBC to the substrate.

FIG. 4 is a photomicrograph (approximately 400× magnification) showing the similar surface modification to a superalloy substrate (Alloy X-40) 30 having a TBC 60 applied over an aluminide diffusion coating 50.

Although certain preferred embodiments and methods have been disclosed herein, it will be apparent from the foregoing disclosure to those skilled in the art that variations and modifications of such embodiments and methods may be made without departing from the true spirit and scope of the invention. Accordingly, it is intended that the invention shall be limited only to the extent required by the appended claims and the rules and principles of applicable law.

What is claimed is:

1. A method for bonding a ceramic thermal barrier coating to a superalloy substrate consisting of:

selecting a superalloy substrate, said superalloy substrate comprising a superalloy material selected from the group consisting of alloys in which the single largest constituent by weight is nickel and alloys in which the single largest constituent by weight is cobalt;

roughening a surface of said superalloy substrate to achieve a surface roughness of 100 to 350 microinches Roughness Average;

thereafter, applying a metallic diffusion to said superalloy substrate, without an intervening bond coating, to form a diffusion coated superalloy substrate having a surface roughness of 100 to 350 microinches Roughness Average; and thereafter plasma spraying a ceramic coating directly onto said diffusion coated superalloy substrate.

2. The method of claim 1 wherein said roughening is effected by grit blasting said surface.

3. The method of claim 1 wherein said roughening is effected by water jet blasting said surface.

4. The method of claim 1 wherein said roughening is effected by laser etching said surface.

5. The method of claim 1 wherein said plasma spraying comprises atmospheric plasma spraying.

6. The method of claim 1 wherein said metallic diffusion coating comprises an aluminide.

7. The method of claim 1 wherein said metallic diffusion coating comprises a metal selected from the group consisting of chromium and alloys of chromium.

8. The method of claim 6 wherein said metallic diffusion coating further includes an element chosen from the group consisting of platinum palladium and rhodium.

9. The method of claim 1, wherein said metallic diffusion coating is applied by pack cementation.

10. The method of claim 1, wherein the step of applying a metallic diffusion coating comprises:

plating said surface with a metal chosen from the group consisting of platinum, palladium, rhodium;

thereafter diffusing an aluminide into said surface.

11. The method of claim 1, wherein:

said metallic diffusion coating diffuses into said substrate to form a diffusion zone of at least 1/10 the thickness of the metallic diffusion coating.

12. A method for bonding a ceramic thermal barrier coating to a superalloy substrate consisting of:

selecting a superalloy substrate, said superalloy substrate comprising a superalloy material selected from the group consisting of alloys in which the single largest constituent by weight is nickel and alloys in which the single largest constituent by weight is cobalt;

roughening a surface of said superalloy substrate to achieve a surface roughness of 100 to 350 microinches Roughness Average;

applying a metallic diffusion coating directly to said substrate, to form a diffusion coated superalloy substrate; and plasma spraying a ceramic coating directly onto said diffusion coated superalloy substrate.

13. The method of claim 12, wherein said metallic diffusion coating comprises an aluminide.

14. The method of claim 13, wherein said aluminide is applied by pack cementation.

15. A method for bonding a ceramic thermal barrier coating to a superalloy substrate consisting of:

selecting a superalloy substrate, said superalloy substrate comprising a superalloy material selected from the group consisting of alloys in which the single largest constituent by weight is nickel and alloys in which the single largest constituent by weight is cobalt, said superalloy substrate having substantially homogeneous chemical composition throughout;

roughening a surface of said superalloy substrate to achieve a surface roughness of 100 to 350 microinches Roughness Average;

plating a noble metal chosen from the group consisting of platinum, palladium and rhodium directly to said surface to form a noble-metal plated superalloy substrate;

applying a metallic diffusion coating directly to said noble-metal plated superalloy substrate, to form a noble metal-metallic diffusion coated superalloy substrate; and plasma spraying a ceramic coating directly onto said noble metal-metallic diffusion coated superalloy substrate.

16. The method of claim 15, wherein said metallic diffusion coating comprises an aluminide.

17. The method of claim 16, wherein said aluminide is applied by pack cementation.

18. A superalloy article having a thermal barrier coating thereon consisting of:

a substrate made from a superalloy, said substrate comprising a superalloy material selected from the group consisting of alloys in which the single largest constituent by weight is nickel and alloys in which the single largest constituent by weight is cobalt, said substrate having a surface comprising microscopic peaks and valleys having a roughness of 100 to 350 microinches Roughness Average;

a metallic diffusion coating diffused into said surface without an intervening bond coating to form a diffusion coated superalloy substrate having a surface roughness of 100 to 350 microinches Roughness Average;

an air plasma sprayed ceramic thermal barrier coating bonded directly to said surface by interlocking surface microstructures formed by application of said air plasma sprayed ceramic thermal barrier coating to said diffusion coated superalloy substrate.

19. The superalloy article of claim 18, wherein:

said interlocking surface microstructures are formed by a flow of plastic ceramic over said microscopic peaks and into said microscopic valleys.

20. The superalloy article of claim 18 wherein:

said substrate comprises a turbine engine component.

21. The superalloy article of claim 18, wherein:

said metallic diffusion coating is diffused into said substrate to form a diffusion zone of at least 1/10 the thickness of the metallic diffusion coating.

* * * * *